US007748309B2

(12) United States Patent
Kim

(10) Patent No.: US 7,748,309 B2
(45) Date of Patent: Jul. 6, 2010

(54) AXLE LOCKING CYLINDER STRUCTURE FOR HEAVY CONSTRUCTION EQUIPMENT

(75) Inventor: Jong In Kim, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 486 days.

(21) Appl. No.: 11/805,967

(22) Filed: May 25, 2007

(65) Prior Publication Data

US 2007/0295419 A1 Dec. 27, 2007

(30) Foreign Application Priority Data

Jun. 9, 2006 (KR) ..... 10-2006-0051879

(51) Int. Cl.
*E02F 9/22* (2006.01)
*B60G 17/005* (2006.01)

(52) U.S. Cl. ..... 91/443; 60/468

(58) Field of Classification Search ..... 60/468; 91/443

See application file for complete search history.

(56) References Cited

U.S. PATENT DOCUMENTS 4,073,311 A * 2/1978 McGeachy ..... 91/443
4,344,497 A * 8/1982 Rathi et al. ..... 180/41
5,263,400 A * 11/1993 Huesser ..... 60/468
6,208,920 B1 * 3/2001 Izawa et al. ..... 280/5.5

FOREIGN PATENT DOCUMENTS

| | | |
|---|---|---|
| DE | 842 574 | 6/1952 |
| DE | 22 09 092 | 9/1973 |
| EP | 0 263 346 | 4/1988 |
| FR | 2 058 788 | 5/1971 |

* cited by examiner

*Primary Examiner*—Thomas E Lazo
(74) *Attorney, Agent, or Firm*—Ladas & Parry LLP

(57) ABSTRACT

An axle locking cylinder structure is capable of enabling an operator of heavy construction equipment to stably carry out an axle locking operation since a sudden variation of the flow rate is prevented in the axle locking cylinder by draining a highly-pressurized flow rate slowly at the release of axle locking and supplying a flow rate quickly at the drive of axle locking. A highly-pressurized hydraulic fluid can be steadily drained from a cylinder chamber since an opening region between a poppet valve and a pilot flow path is enlarged so as to open the pilot flow path connected to the cylinder chamber during a relatively long time. A cylinder rod can be quickly expanded according to the manipulation of an axle locking switch by compensating a flow rate supplied to a cylinder chamber when the cylinder rod is expanded.

1 Claim, 4 Drawing Sheets

AXLE LOCKING CYLINDER STRUCTURE FOR HEAVY CONSTRUCTION EQUIPMENT

CROSS-REFERENCE TO RELATED APPLICATION

This application is based on and claims priority from Korean Patent Application No. 10-2006-51879, filed on Jun. 9, 2006 in the Korean Intellectual Property Office, the disclosure of which is incorporated herein in its entirety by reference.

BACKGROUND OF THE INVENTION

1. Field of the invention

The present invention relates to an axle locking cylinder structure for heavy construction equipment, and more particularly, to an improved axle locking cylinder structure capable of enabling an operator to stably carry out an axle locking operation since a sudden variation of a flow rate is prevented in the axle locking cylinder by draining a highly-pressurized flow rate slowly at the release of axle locking and supplying a flow rate quickly at the drive of axle locking.

2. Description of the Prior Art

Generally, an axle locking apparatus is used for a wheel-type excavator with tires. The axle locking apparatus is to control the rotation of an axle by use of a proper hydraulic pressure at the operation of the excavator so that the tires are fixed on the ground to prevent the equipment from being moved at work.

Referring to FIGS. 1 and 2, an axle locking cylinder includes a locking cylinder 10 connected to a supply flow path 1 which communicates with a main hydraulic pump (not shown), and a return fluid path 2 which communicates with a pressurized reservoir (not shown), the locking cylinder 10 being fed with a hydraulic fluid through the supply flow path; a cylinder rod 3 slidably moved in the locking cylinder by the pressure of the hydraulic fluid supplied to the locking cylinder 10; and a pilot valve 11 installed between the supply flow path 1 communicating with the main hydraulic pump and the flow path 13 communicating with the cylinder chamber 4 in the locking cylinder 10.

Also, the pilot valve 11 includes a first pilot flow path 12 fed with the hydraulic fluid through the supply flow path 1 to drain a pilot pressure; a poppet valve 14 moved up and down by the pilot pressure to selectively open and close a pilot flow path 13 connected to the cylinder chamber 4; a pressurized chamber 15 formed between the poppet valve 14 and the pilot flow path 13; a valve spring 16 resiliently supporting the poppet valve 14 downward to close the pilot flow path 13; a second pilot flow path 17 feeding the hydraulic fluid drained from the cylinder chamber 4 to the return flow path 2 when the pilot flow path 13 is opened; and an adjusting plug 18 coupled to an upper portion of the locking cylinder 10 for adjusting the resilient force of the valve spring 16.

According to the conventional axle locking cylinder, when an operator shifts the axle locking switch (not shown) to a locking position, the poppet valve 14 is downwardly moved by the resilient force of the valve spring 16 to close the pilot flow path 13. Consequently, the hydraulic fluid is not discharged from the locking cylinder 10 to fix the cylinder rod 3.

The operator can operate the excavator, without spreading outriggers or blades.

The conventional axle locking cylinder has several problems when the axle locking switch is released.

More specifically, if the operator shifts the axle locking switch to a release position, the hydraulic fluid is fed to the pressurized chamber of the pilot valve through the first pilot flow path. The hydraulic fluid serves as a gauge pressure of the poppet valve to push up the poppet valve.

In this instance, the pilot flow path closed by a pocket seat portion is opened, and the hydraulic fluid in the cylinder chamber communicates with the return flow path connected to the pressurized reservoir.

As a result, the cylinder rod is moved in the locking cylinder according to the load applied to the axle, thereby maintaining a certain pressure in the locking cylinder.

According to the construction of the conventional axle locking cylinder, however, since the poppet seat portion and the seat region of the pilot flow path are small, the poppet valve is opened during a short time, so that the highly-pressurized hydraulic fluid is rapidly discharged.

The operator is suddenly shocked when the axle locking apparatus is shifted to the release position, which deteriorates the stability of the equipment.

In case the poppet valve and the pilot flow path are controlled to be more smoothly opened in order to relieve the sudden shock of the axle locking cylinder, it may decrease the flow rate applied to the cylinder chamber. There is a problem in that, if the flow rate is decreased, the drive speed of the cylinder rod is remarkably decelerated.

SUMMARY OF THE INVENTION

Accordingly, the present invention has been made to solve the above-mentioned problems occurring in the prior art while advantages achieved by the prior art are maintained intact.

One object of the present invention is to provide an axle locking cylinder structure capable of steadily draining a highly-pressurized hydraulic fluid from a cylinder chamber since an opening region between a poppet valve and a pilot flow path is enlarged so as to open the pilot flow path connected to the cylinder chamber during a relatively long time.

Another object of the present invention is to provide an axle locking cylinder structure capable of quickly expanding a cylinder rod according to the manipulation of an axle locking switch by compensating a flow rate supplied to a cylinder chamber when the cylinder rod is expanded.

In order to accomplish these objects, there is provided an axle locking cylinder structure for heavy construction equipment including a locking cylinder connected to a supply flow path which communicates with a main hydraulic pump, and a return fluid path which communicates with a pressurized reservoir, the locking cylinder being supplied with a hydraulic fluid through the supply flow path; a cylinder rod slidably moved in the locking cylinder by a pressure of the hydraulic fluid supplied to the locking cylinder; and a pilot valve installed between the supply flow path communicating with the main hydraulic pump and the flow path communicating with the cylinder chamber in the locking cylinder; the axle locking cylinder structure comprising: a first pilot flow path fed with the hydraulic fluid through the supply flow path to drain a pilot pressure; a poppet valve moved up and down by the pilot pressure to selective open and close a pilot flow path connected to the cylinder chamber, the poppet valve having a poppet stepped portion extending from a poppet seat portion towards a front end thereof and having a diameter smaller than that of the pilot flow path; a pressurized chamber formed between the poppet valve and the pilot flow path; a valve spring resiliently supporting the poppet valve downward to close the pilot flow path; a second pilot flow path feeding the hydraulic fluid drained from the cylinder chamber to the return flow path when the pilot flow path is opened; a branched flow path formed between the cylinder chamber and the supply flow path and connected in parallel with the pilot valve to supply the hydraulic fluid to the cylinder chamber when the cylinder rod is expanded; and an adjusting plug coupled to an upper portion of the locking cylinder for adjusting the resilient force of the valve spring.

The axle locking cylinder structure further comprises a check valve installed to one side of the branched flow path.

The check valve is fed with a certain pilot pressure through a third pilot flow path which communicates with the pressurized chamber, and has a valve plunger for selectively opening and closing the branched flow path by using the pilot pressure.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
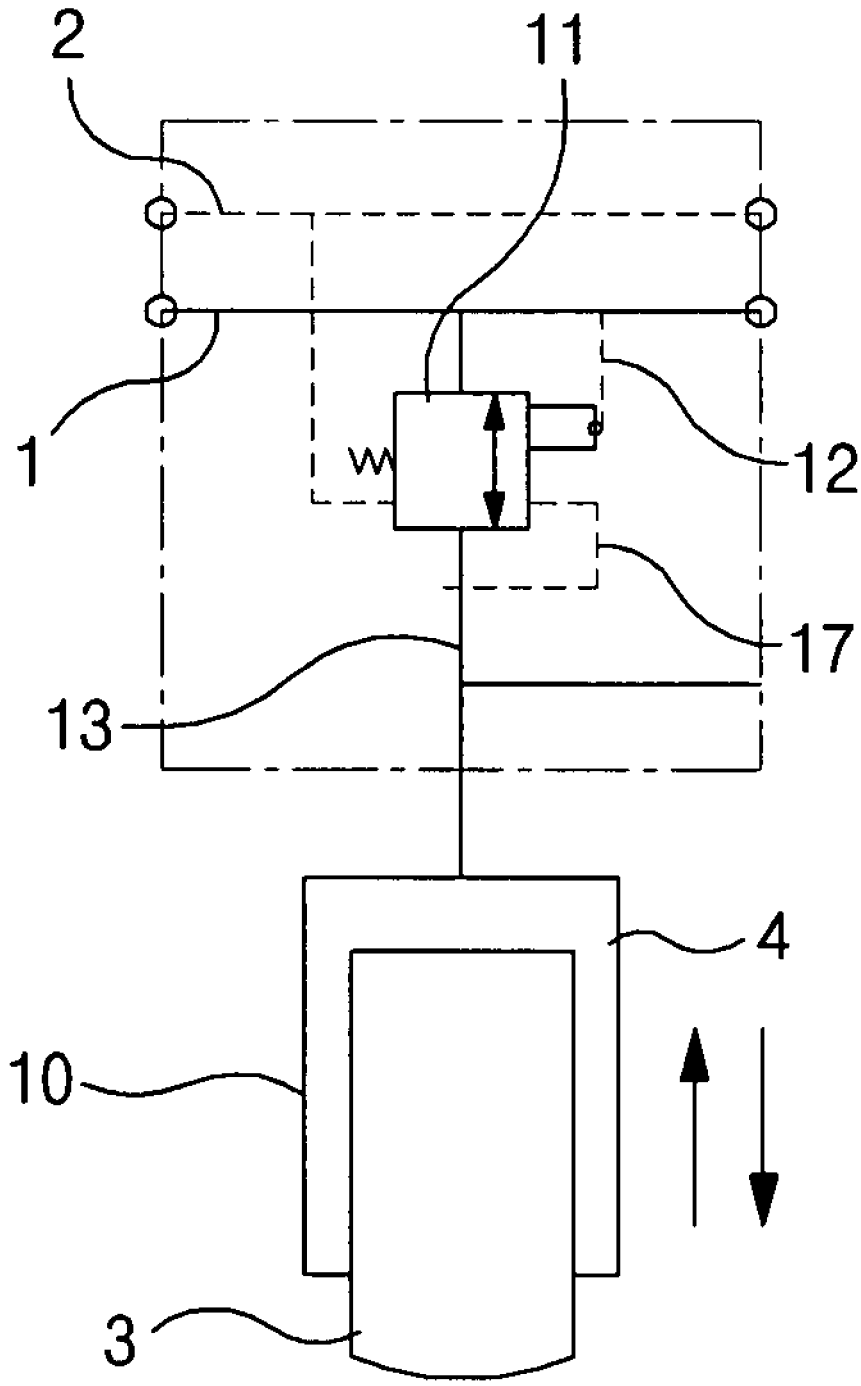
Fig. 1 Prior Art
FIG. 1 is a circuit diagram of a conventional axle locking cylinder.
Figure 2:
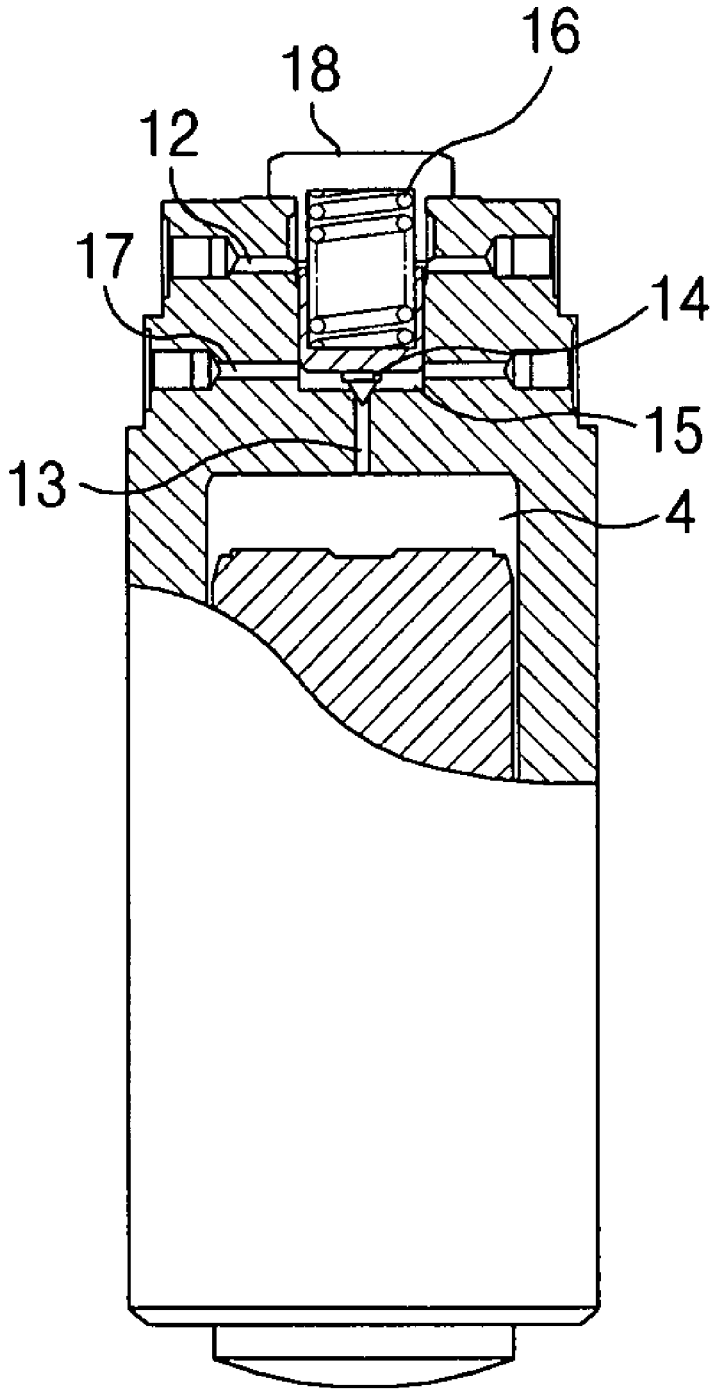
Fig. 2 Prior Art
FIG. 2 is a partially cross-sectional view illustrating the axle locking cylinder shown in FIG. 1.
Figure 3:
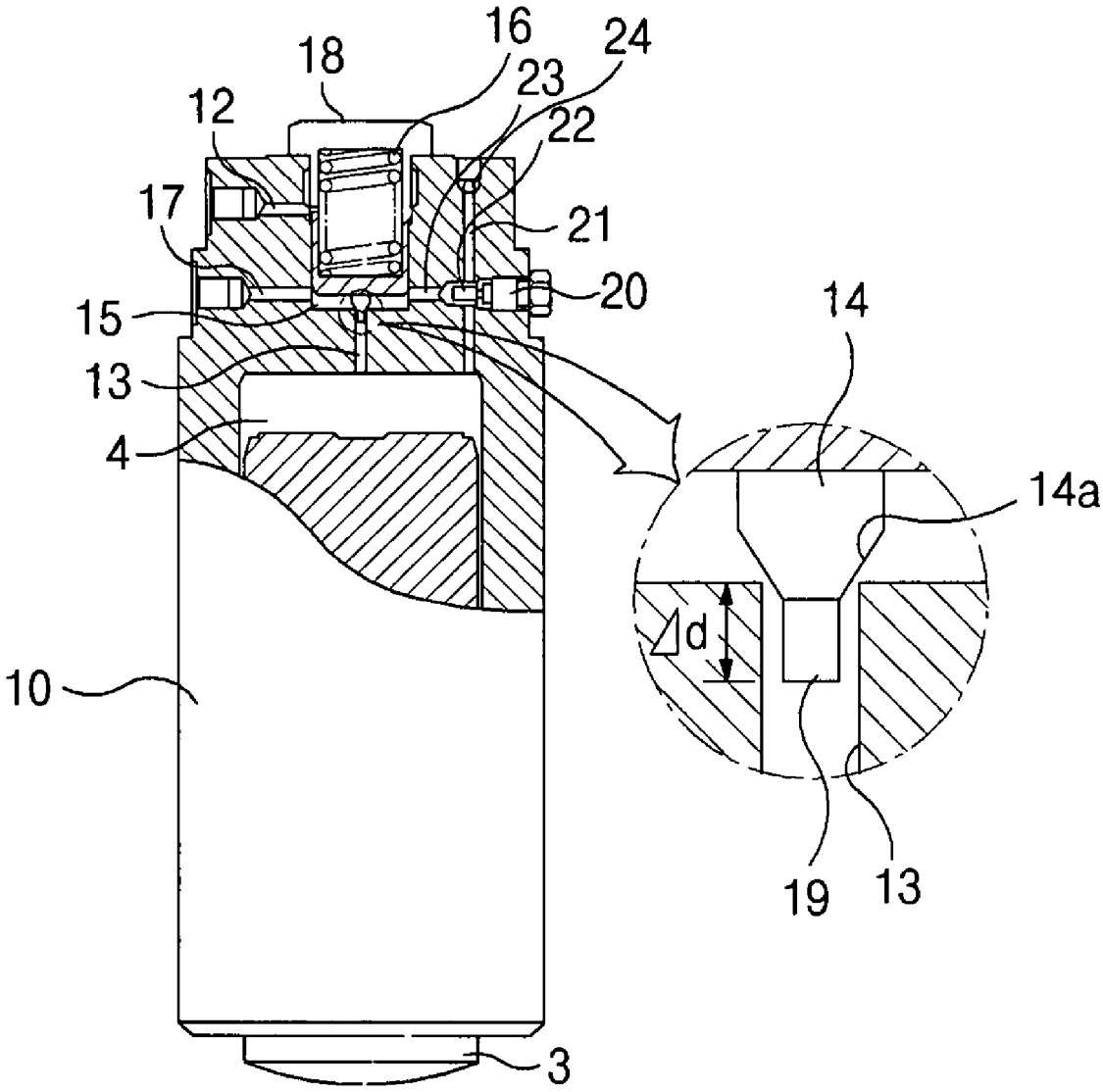
FIG. 3 is a partially cross-sectional view illustrating an axle locking cylinder structure according to an embodiment of the present invention.
Figure 4:
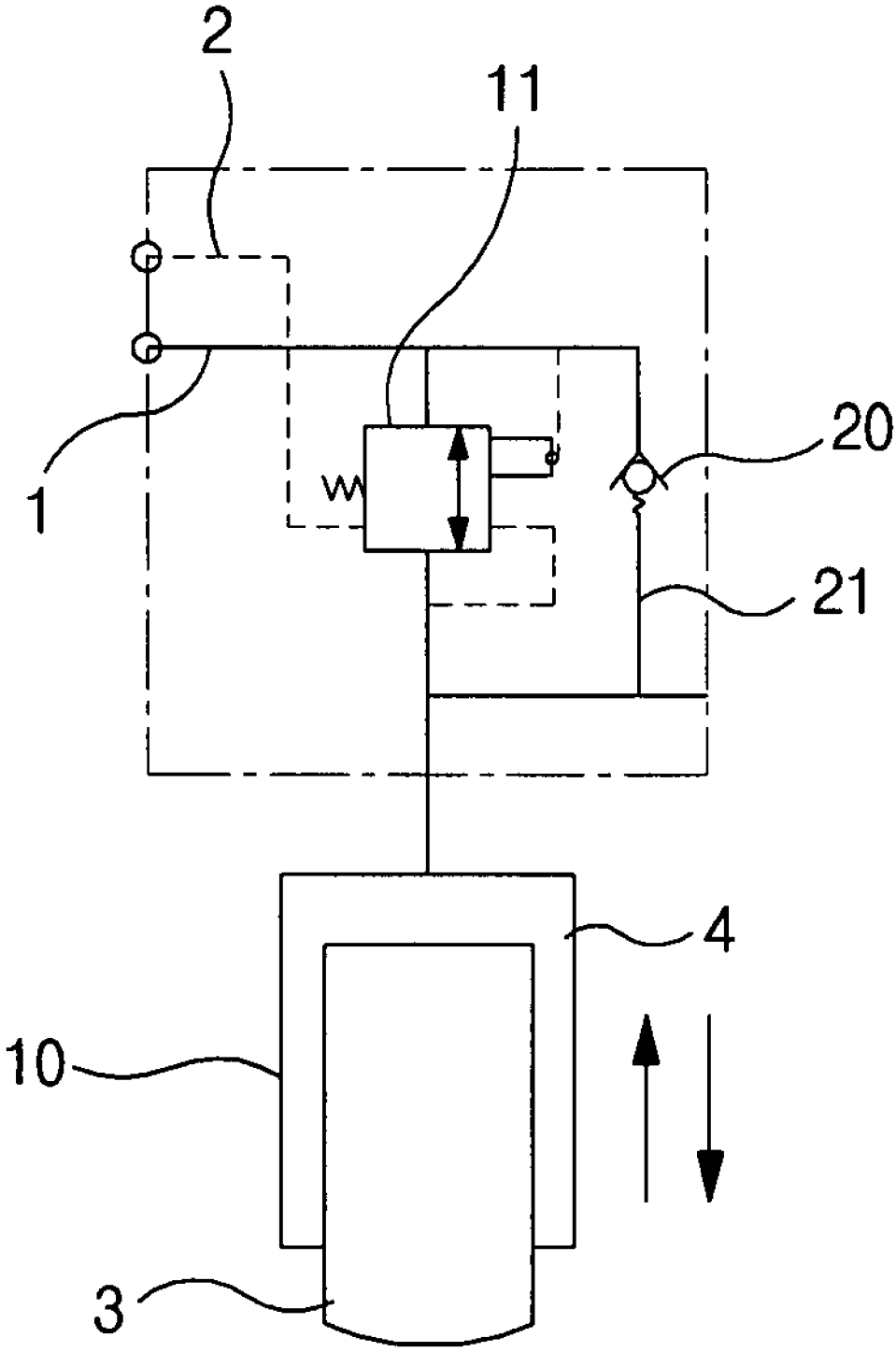
FIG. 4 is a circuit diagram of the axle locking cylinder shown in FIG. 3.

FIG. 3 is a partially cross-sectional view illustrating an axle locking cylinder structure according to an embodiment of the present invention, and FIG. 4 is a circuit diagram of the axle locking cylinder shown in FIG. 3.

The axle locking cylinder structure according to this embodiment includes, as shown in FIGS. 3 and 4, a locking cylinder 10 connected to a supply flow path 1 which communicates with a main hydraulic pump (not shown), and a return fluid path 2 which communicates with a pressurized reservoir (not shown), the locking cylinder 10 supplied with a hydraulic fluid through the supply flow path 1; a cylinder rod 3 slidably moved in the locking cylinder 10 by the pressure of the hydraulic fluid supplied to the locking cylinder 10; and a pilot valve 11 installed between the supply flow path 1 communicating with the main hydraulic pump and the flow path 13 communicating with the cylinder chamber 4 in the locking cylinder 10.

The axle locking cylinder structure for heavy construction equipment according to this embodiment includes a first pilot flow path 12 fed with the hydraulic fluid through the supply flow path 1 to drain a pilot pressure; a poppet valve 14 moved up and down by the pilot pressure to selective open and close a pilot flow path 13 connected to the cylinder chamber 4, the poppet valve 14 having a poppet stepped portion 19 extending from a poppet seat portion 14 towards a front end thereof and having a diameter smaller than that of the pilot flow path 13; a pressurized chamber 15 formed between the poppet valve 14 and the pilot flow path 13; a valve spring 16 resiliently supporting the poppet valve 14 downward to close the pilot flow path 13; a second pilot flow path 17 feeding the hydraulic fluid drained from the cylinder chamber 4 to the return flow path 2 when the pilot flow path 13 is opened; a branched flow path 21 formed between the cylinder chamber 4 and the supply flow path 1 and connected in parallel with the pilot valve 11 to supply the hydraulic fluid to the cylinder chamber 4 when the cylinder rod is expanded; and an adjusting plug 18 coupled to an upper portion of the locking cylinder 10 for adjusting the resilient force of the valve spring 16.

A check valve 20 is installed to one side of the branched flow path 21.

In the axle locking cylinder according to the present invention, the check valve 20 is fed with a certain pilot pressure through a third pilot flow path 23 which communicates with the pressurized chamber 15, and has a valve plunger 22 for selectively opening and closing the branched flow path 21 by using the pilot pressure.

The operation of the axle locking cylinder structure for the heavy construction equipment according to the present invention will now be described.

When an operator manipulates the axle locking, the certain hydraulic fluid is fed to the pilot valve 11 through the first pilot flow path 12, so that the poppet valve 14 closes the pilot flow path 13 to maintain the axle locking state.

In particular, when the axle locking is released in order to move the equipment after completing the work, the axle locking cylinder is fed with the pilot pressure through the second pilot flow path 17. The pilot pressure serves as a gauge pressure of the poppet valve 14 to push up the poppet seat portion 14*a* from the pilot flow path 13.

In this instance, since the poppet stepped portion 19 delays the open time of the pilot path 13 by a certain opening region $\Delta d$ in the pilot flow path 13, the highly-pressurized hydraulic fluid is steadily drained from the cylinder chamber 4. Consequently, the operator can manipulate the equipment stably, without shocking the operator due to the sudden drain of the hydraulic fluid from the locking cylinder 10.

This is because the poppet stepped portion 19 serves as an orifice function when the hydraulic fluid passes through the opening region $\Delta d$ when the pilot flow path 13 is opened. It means to prevent the shock from being applied to the operator when the high pressure is shifted to a low pressure in the locking cylinder 10.

Also, when the cylinder rod 3 is expanded, the valve plunger 22 install in the branched flow path 21 is moved by the pilot pressure passing through the third pilot flow path 23, thereby opening the check valve 20. Consequently, since the more flow rate is supplied to the cylinder chamber 4, the cylinder rod 3 is quickly expanded.

With the above description, according to the axle locking cylinder structure for the heavy construction equipment according to the present invention, the operator can manipulate the equipment without getting the shock, when the high pressure is shifted to the low pressure in the locking cylinder. When the cylinder rod is expanded, a sufficient flow rate is supplied to the locking cylinder, so that the cylinder rod is quickly expanded.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An axle locking cylinder structure for heavy construction equipment, including a locking cylinder connected to a supply flow path which communicates with a main hydraulic pump, and a return fluid path which communicates with a pressurized reservoir, the locking cylinder being supplied with a hydraulic fluid through the supply flow path; a cylinder rod slidably moved in the locking cylinder by a pressure of the hydraulic fluid supplied to the locking cylinder; and a pilot valve installed between the supply flow path communicating with the main hydraulic pump and the flow path communicating with the cylinder chamber in the locking cylinder; the axle locking cylinder structure comprising:

a first pilot flow path fed with the hydraulic fluid through the supply flow path to drain a pilot pressure;

a poppet valve moved up and down by the pilot pressure to selective open and close a pilot flow path connected to the cylinder chamber, the poppet valve having a poppet stepped portion extending from a poppet seat portion towards a front end thereof and having a diameter smaller than that of the pilot flow path;

a pressurized chamber formed between the poppet valve and the pilot flow path;

a valve spring resiliently supporting the poppet valve downward to close the pilot flow path;

a second pilot flow path feeding the hydraulic fluid drained from the cylinder chamber to the return flow path when the pilot flow path is opened;

a branched flow path formed between the cylinder chamber and the supply flow path and connected in parallel with the pilot valve to supply the hydraulic fluid to the cylinder chamber when the cylinder rod is expanded; and an adjusting plug coupled to an upper portion of the locking cylinder for adjusting the resilient force of the valve spring, and further comprising a check valve installed to one side of the branched flow path, wherein the check valve is fed with a certain pilot pressure through a third pilot flow path which communicates with the pressurized chamber, and has a valve plunger for selectively opening and closing the branched flow path by using the pilot pressure.

* * * * *